US008807777B2

(12) United States Patent
Watanabe

(10) Patent No.: US 8,807,777 B2
(45) Date of Patent: Aug. 19, 2014

(54) LIGHT GENERATING UNIT AND APPARATUS EQUIPPED WITH A PLURALITY OF LIGHT GENERATING UNITS

(75) Inventor: Masaru Watanabe, Tokyo (JP)

(73) Assignee: Lapin Create, Inc., Nerima-Ku, Tokyo (JP)

( * ) Notice: Subject to any disclaimer, the term of this patent is extended or adjusted under 35 U.S.C. 154(b) by 362 days.

(21) Appl. No.: 13/389,688

(22) PCT Filed: Aug. 6, 2010

(86) PCT No.: PCT/JP2010/004964

§ 371 (c)(1),
(2), (4) Date: Mar. 6, 2012

(87) PCT Pub. No.: WO2011/018889

PCT Pub. Date: Feb. 17, 2011

(65) Prior Publication Data

US 2012/0188749 A1 Jul. 26, 2012

(30) Foreign Application Priority Data

Aug. 10, 2009 (JP) ..... 2009-185843

(51) Int. Cl.

| | |
|---|---|
| ***F21V 33/00*** | (2006.01) |
| ***G09F 19/00*** | (2006.01) |
| ***G09F 13/24*** | (2006.01) |
| ***F21S 10/00*** | (2006.01) |
| *F21V 9/12* | (2006.01) |

(52) U.S. Cl.

CPC ..... *G09F 13/24* (2013.01); *F21S 10/002* (2013.01); *F21V 9/12* (2013.01)

USPC ..... 362/101; 362/96; 40/406; 40/407; 40/439

(58) Field of Classification Search

CPC ..... G09F 13/24; F21S 10/002; F21V 9/12

USPC ..... 362/101, 96; 40/406, 407, 439–441

See application file for complete search history.

(56) References Cited

U.S. PATENT DOCUMENTS

| | | | |
|---|---|---|---|
| 5,349,771 | A | 9/1994 | Burnett |
| 5,363,577 | A | 11/1994 | Fuller et al. |

(Continued)

FOREIGN PATENT DOCUMENTS

| | | | |
|---|---|---|---|
| JP | 3002202 | U | 9/1994 |
| JP | 10-260651 | A | 9/1998 |
| JP | 11-184420 | A | 7/1999 |
| JP | 2004-264383 | A | 9/2004 |
| JP | 2005-528733 | A | 9/2005 |

OTHER PUBLICATIONS

International Search Report (PCT/ISA/210) issued on Nov. 16, 2010, by Japanese Patent Office as the International Searching Authority for International Application No. PCT/JP2010/004964.

(Continued)

*Primary Examiner* — David J Makiya

(74) *Attorney, Agent, or Firm* — Buchanan Ingersoll & Rooney PC

(57) ABSTRACT

There is provided a light generating unit including a transparent vessel that is elongated and contains water and a light-emitting/bubble producing unit that is attached to a base plate of the vessel. The light-emitting/bubble producing unit includes a plurality of LEDs arranged around inner surfaces of side walls of the vessel and a plurality of nozzles for discharging gas that are disposed on an inside of the plurality of LEDs. Also provided is a display apparatus in which a plurality of the light generating units are arranged with the vessels adjacent to one another so as to construct a light generating block in the shape of a wall and which is capable of displaying images and/or information by way of bubbles and illumination light.

9 Claims, 6 Drawing Sheets

(56) References Cited

U.S. PATENT DOCUMENTS

| | | | | |
|---|---|---|---|---|
| 6,065,850 | A * | 5/2000 | Chiu | 362/101 |
| 6,070,348 | A | 6/2000 | Bianchetti | |
| 6,135,604 | A | 10/2000 | Lin | |
| 6,153,273 | A | 11/2000 | Lee | |
| 6,172,658 | B1 * | 1/2001 | Romberg | 345/30 |
| 6,187,394 | B1 * | 2/2001 | Johnson et al. | 428/13 |
| 6,865,833 | B2 * | 3/2005 | Kliakhandler et al. | 40/406 |
| 2004/0052076 | A1 | 3/2004 | Mueller et al. | |
| 2006/0238659 | A1 | 10/2006 | Watanabe et al. | |

OTHER PUBLICATIONS

Notification of Transmittal of Translation of the International Preliminary Report on Patentability (Forms PCT/IB/338 and PCT/IPEA/409) issued on Feb. 23, 2012, in the corresponding International Application No. PCT/JP2010/004964. (5 pages).

* cited by examiner

LIGHT GENERATING UNIT AND APPARATUS EQUIPPED WITH A PLURALITY OF LIGHT GENERATING UNITS

TECHNICAL FIELD

The present invention relates to a light generating unit.

BACKGROUND ART

Japanese Laid-Open Patent Publication No. 2004-264383 discloses the provision of a display apparatus capable of reproducing beautiful images with uniformity and clarity using bubbles. The display apparatus disclosed in this publication has a plurality of elongated containers disposed side by side with their lengths directed vertically, the elongated containers contain water, and an air feed pipe corresponding to each elongated container for feeding air from the bottom of the elongated container includes: a solenoid valve switched on and off under the control of a controller for feeding and stopping the feeding of air supplied from an air pump; a flow controller capable of maintaining the flow rate of the air to be fed at a predetermined value; and a check valve, such elements being disposed in order in the direction of feed and an air stone being provided at the end thereof. Microbubbles are generated from a filter at substantially the outer circumference of the air stone and images are displayed using the bubbles.

DISCLOSURE OF THE INVENTION

There is demand for an apparatus capable of reproducing more beautiful and/or more colorful images using bubbles.

One aspect of the present invention is a light generating unit including: a transparent vessel that is elongated and contains a liquid; and a light-emitting/bubble producing unit (light-emitting and bubble producing unit) attached to a base portion of the vessel. The light-emitting/bubble producing unit includes a plurality of light-emitting elements disposed around inner surfaces of side walls of the vessel and a plurality of nozzles for discharging a gas that are disposed on an inside of the plurality of light-emitting elements. With this light generating unit, the side walls of the vessel can be illuminated with like of a single color or multiple colors outputted from the plurality of light-emitting elements of the light-emitting/bubble producing unit. It is also possible to guide the light from the plurality of light-emitting elements along the elongated vessel using reflection at the side walls of the vessel.

In addition, it is possible to scatter the light of a single color or multiple colors guided along the vessel using bubbles of gas discharged from the plurality of nozzles. Accordingly, in this light generating unit, it is possible to produce a variety of displays and representations using changes in the color of the side walls of the vessel, movement of the bubbles that observed thought the side walls, and also changes in light due to the movement of the bubbles.

In the light-emitting/bubble producing units, the plurality of light-emitting elements should preferably include light-emitting elements, typically LEDs, of various colors, for example R (red), G (green), and blue (B). By doing so, it is possible to output illumination light of multiple colors while controlling the color and time (timing). It is also possible to output illumination light of multiple colors while controlling the color and time (timing) according to another method, such as control in synchronization with a rotating color filter and a light emitting from the plurality of light-emitting elements. In addition, by controlling the timing at which gas is discharged from the plurality of nozzles, it is possible to control the timing at which a plurality of bubbles are discharged from the light-emitting/bubble producing unit. This means that it is possible to produce a variety of representations and displays by changing the movement of bubbles and changing the illumination light along the elongated vessel of the light generating unit.

In this light generating unit, the vessel may include a base plate that is transparent and is provided with an opening in a center thereof, and the light-emitting/bubble producing unit may include a convex portion that is fitted into the opening of the base plate from below and a flange portion that seals the opening of the base plate at a circumference of the convex portion. The plurality of nozzles may be provided at the convex portion and the plurality of light-emitting elements may be disposed so as to face the base plate around a circumference of the flange portion. The light generating unit can be assembled by merely fitting or inserting the convex portion of the light-emitting/bubble producing unit into the base plate. It is also possible to detachably attach the light-emitting/bubble producing unit to the base plate, which facilitates maintenance of the light-emitting/bubble producing unit. By exchanging the light-emitting/bubble producing unit, it is also possible to output bubbles of a different size or with different movement by changing the diameters and arrangement of nozzles for discharging gas and/or to produce illumination light of a different balance of colors.

In addition, the light-emitting/bubble producing unit should preferably include a cylindrical cavity that passes through the flange portion and reaches the convex portion to form a partition wall at a front end of the convex portion, the plurality of nozzles being formed effectively in a direction in which an inner circumferential surface of the cylindrical cavity extends. It is possible to machine the channels that supply gas to the plurality of nozzles and the plurality of nozzles themselves from the flange portion side, which means that the light-emitting/bubble producing unit can be provided at low cost.

In addition, a front end of the cylindrical cavity should preferably be dome-shaped. Since the part at the front end of the cylindrical cavity that is connected to the plurality of nozzles has an overall swollen shape which facilitates the accumulation of gas, it is possible to stably produce bubbles from the gas discharged from the plurality of nozzles.

Another aspect of the present invention is an apparatus including: a light generating block in which a plurality of the light generating units described above are arranged; and a control unit controlling timing of coloration and bubble discharge of the respective light-emitting/bubble producing units of the plurality of light generating units. The vessels of the plurality of light-emitting elements may be arranged in the form of a straight pillar or a circular column, or twisted in a spiral to provide apparatuses with light-emitting blocks of a variety of forms.

A typical example of a light generating block has the plurality of light generating units arranged so that the vessels construct a wall and illuminates the respective vessels and the bubbles rising inside the vessels with light of various colors. It is also possible to display characters and images using bubbles that rise in the respective vessels and to use the light generating block as a display.

In a light generating block where vessels are disposed adjacently, one or more side walls of the vessels of the plurality of light generating units may also be used as side walls of the adjacent vessels. The light generating block should preferably also include first through channels that pass through and fluidly connect adjacent vessels at base ends thereof and second through channels that pass through adjacent vessels at front ends thereof to fluidly connect regions containing the liquid. Since it is possible to use the adjacent vessels as through pipes, it is possible to suppress fluctuations in liquid pressure inside the vessels due to the formation and rising of the bubbles, and to suppress fluctuation in the velocity with which the bubbles rise. The initial introduction of the liquid into a plurality of vessels also becomes easier.

It is preferable for the cross-sectional area of each second through channel to be larger than the cross-sectional area of each first through channel. Since the fluctuations in pressure at the base portion where the bubbles are formed is large, by making the cross-sectional area of the first through channels relatively small, it is possible to lower the extent to which fluctuations in pressure at the base portion affect adjacent vessels.

In addition, the control unit should preferably include a plurality of light emission control units that respectively control coloration of the plurality of light-emitting/bubble producing units and a plurality of bubble discharge control units that respectively control bubble discharge by the plurality of light-emitting/bubble producing units, wherein the plurality of light emission control units and the plurality of bubble discharge control units are connected in a daisy chain by a DMX data link. DMX (DMX512-A, Asynchronous Serial Digital Data Transmission Standard for Controlling Lighting Equipment and Accessories) is a communication protocol mainly used to control stage lighting and performance appliances, and is capable of connecting a plurality of controlled appliances in a daisy chain. Accordingly, by using a controller that controls appliances according to DMX protocol, it is possible to control coloration and bubble discharge by the plurality of light-emitting/bubble producing units and to control the display or representation of the light generating block using a control system of a simple construction.

DETAIL DESCRIPTION

Figure 1:
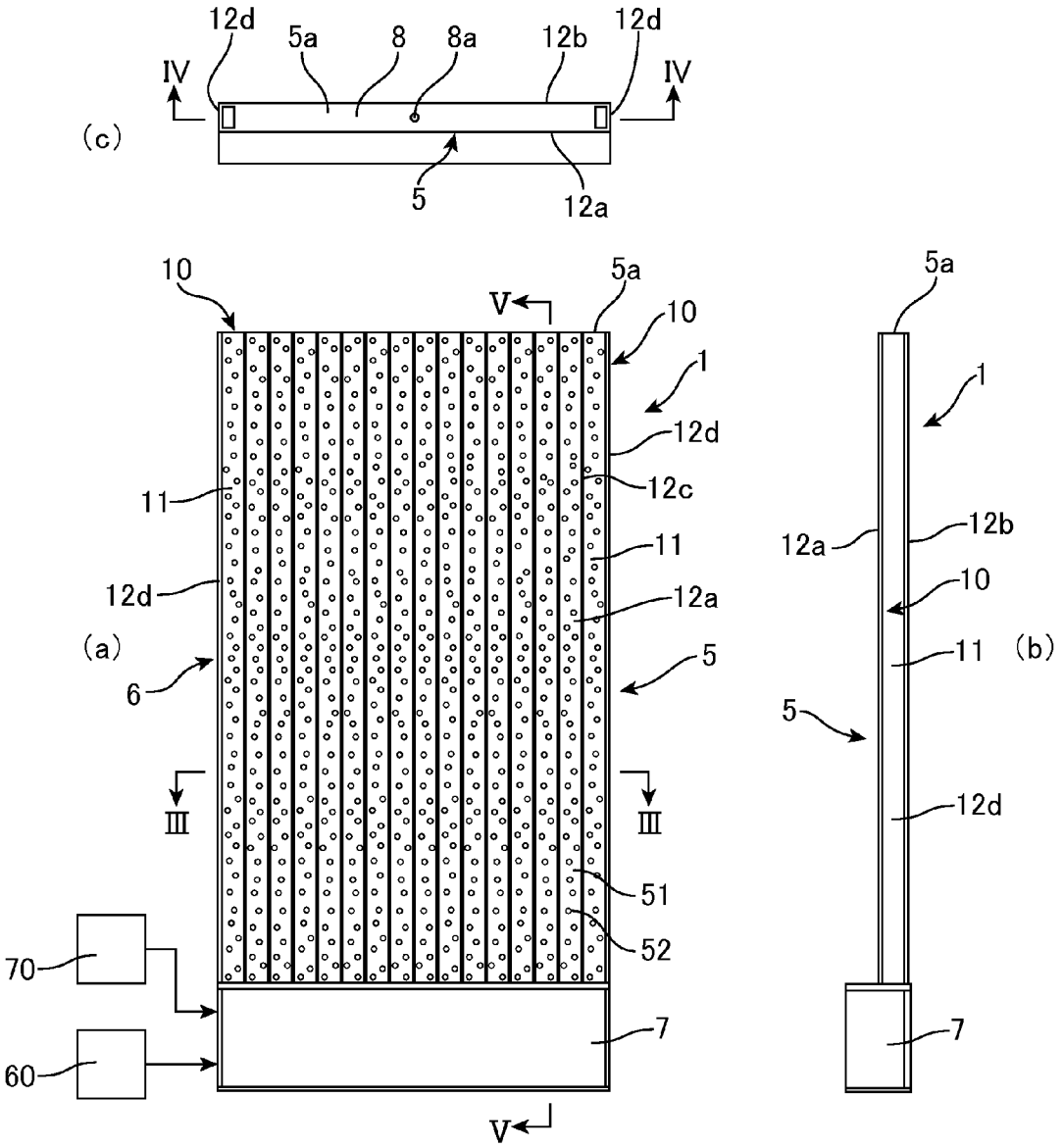
FIG. 1 is a series of diagrams showing an overview of a display apparatus 1, where FIG. 1(*a*) is a front view, FIG. 1(*b*) is a right-side view, and FIG. 1(*c*) is a plan view.

FIG. 1 shows an overview of a display apparatus that is one embodiment of the present invention. FIG. 1(*a*) is a front view of a display apparatus 1, FIG. 1(*b*) is a right-side view of the display apparatus 1, and FIG. 1(*c*) is a plan view of the display apparatus 1. The display apparatus 1 includes a light generating block (lighting block, light-emitting block) 5, in which a plurality of light generating units (lighting units, light-emitting units) 10 are aligned so as to form a wall surface 6, and a base 7 that supports the light generating block 5. The plurality of light generating units (light-emitting units) 10 each includes an elongated vessel (container) 11. Light-emitting/bubble producing units corresponding to the respective light generating units 10 are housed in the base 7. The individual light-emitting/bubble producing units illuminate the vessels 11 of the light generating units 10 with multiple colors and form bubbles 52 by releasing gas (typically air) into a liquid (typically water) 51 contained inside the vessels 11. The upper end 5*a* of the light generating block 5 is covered with a cover 8 and a discharge outlet 8*a* is provided for releasing air that has risen as bubbles inside the vessels 11 of the plurality of light generating units 10 to the outside atmosphere.

The vessel 11 of a typical light generating unit 10 is surrounded in four directions by side walls 12*a* and 12*b* at the front and back that are made of transparent acrylic and side walls 12*c* that form partitions and has a space whose cross-section in the horizontal direction is rectangular formed inside, with such space extending in the vertical direction. Accordingly, the vessel 11 is in the form of an elongated tube (square tube) and is capable of containing the liquid 51 inside. The light generating block 5 of the display apparatus 1 includes sixteen vessels 11 that are adjacently disposed in a row, and the side walls (partition walls) 12*c* of adjacent vessels 11 are composed of shared acrylic boards. Accordingly, in the light generating block 5, the plurality of vessels 11 are formed by partitioning a wall-like water tank using a plurality of acrylic boards. As one example of the size of the respective vessels 11, the length in the vertical direction is 1000 mm and the internal space that contains liquid has a square cross section with 34 mm edges. The front and rear walls (side walls) 12*a* and 12*b* of the light-emitting block 5 upon which water pressure acts and the left and right side walls 12*d* are transparent acrylic boards that are 5 to 6 mm thick, and the side walls 12*c* that form partitions are transparent acrylic boards that are 3 to 4 mm thick.

The various values given above are merely examples and the light generating block (lighting block, light-emitting block) 5 may be constructed of 17 or more or 15 or fewer vessels 11. The size of the vessels 11 is also not limited to the size given above. Also, by using a plurality of light generating blocks 5 and/or a plurality of display apparatuses 1, it is also possible to construct an even larger wall surface. So long as the material that constructs the side walls 12*a* to 12*d* is transparent or translucent, such material is not limited to acrylic boards and may be plate glass. To suppress adhesion of the bubbles to the inner surfaces of the vessels 11 and to improve rinsing, it is also effective for an aqueous solution that includes a small amount of a constituent such as a surfactant to be contained as the liquid 51.

In the display apparatus 1 by connecting an air source, for example a compressor 60, that supplies gas for forming the bubbles 52 and a control console 70 that supplies signals for controlling the display apparatus 1 and the power used for illumination, the light generating block 5 is capable of a variety of performances according to the bubbles 52 and the color of the illumination light. For example, in FIG. 1, by continuously introducing the bubbles 52 into all of the vessels 11 of the light generating block 5 and illuminating the inner surfaces of the vessels 11 with light of various colors, it is possible to use the lighting block 5 as a wall surface that lights up in the colors of the rainbow.

Figure 2:
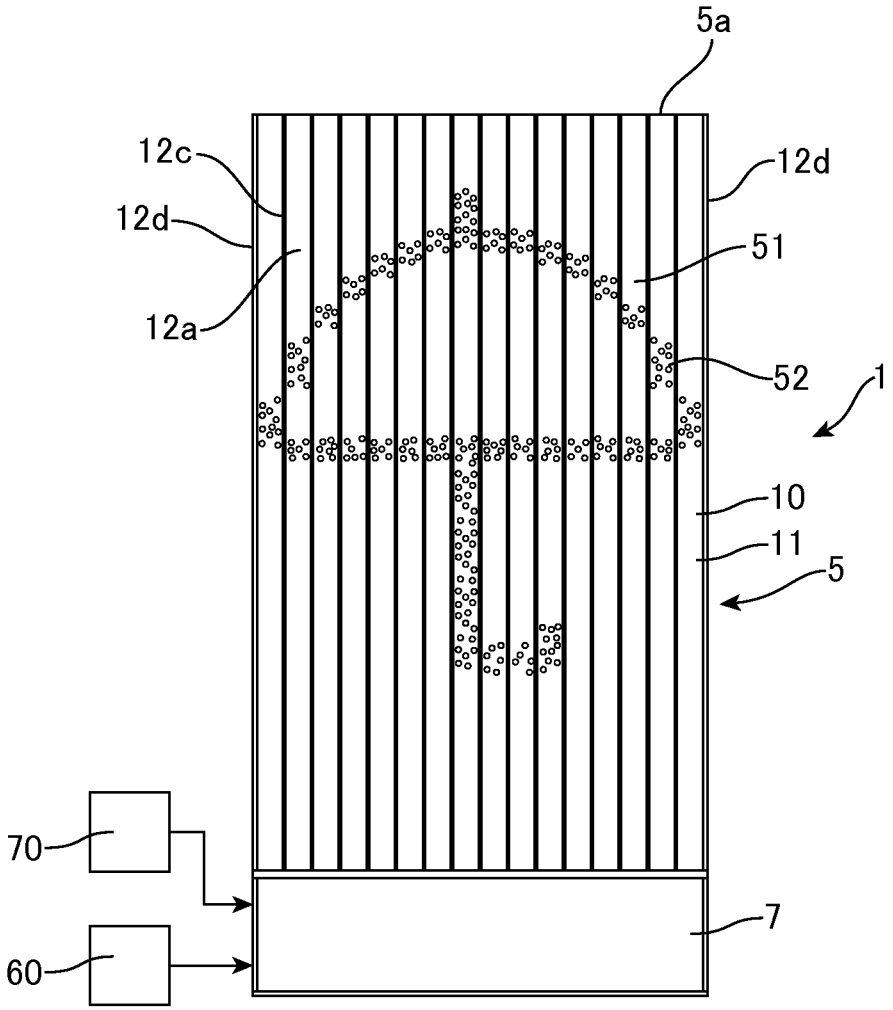
FIG. 2 is a front view of the display apparatus 1 and shows a different example display.

Also, as shown in FIG. 2, by controlling the timing and amount of bubbles 52 introduced into the respective vessels 11, it is possible to draw an image or characters that light up in one or many colors on the lighting block 5.

Figure 3:
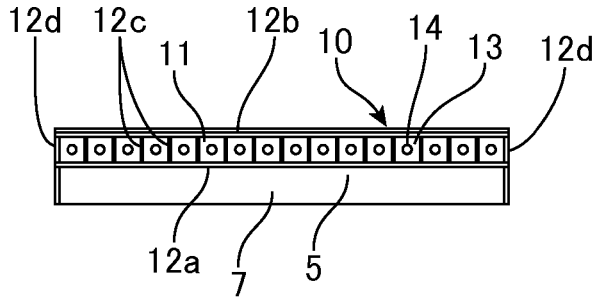
FIG. 3 is a III-III cross-sectional view of the display apparatus 1 where the display apparatus 1 is sliced on a horizontal plane.

FIG. 3 to FIG. 7 show the construction of the display apparatus 1 in more detail by way of cross-sectional views and enlargements. FIG. 3 is a cross-sectional view where the light generating block 5 has been sliced on a horizontal plane so that a base plate 13 that constructs a base ("base end" or "bottom plate") of the vessel 11 of each light generating unit 10 that constructs the lighting block 5 can be seen. The base plates 13 are also transparent acrylic boards and have openings 14 formed in the center thereof.

Figure 4:
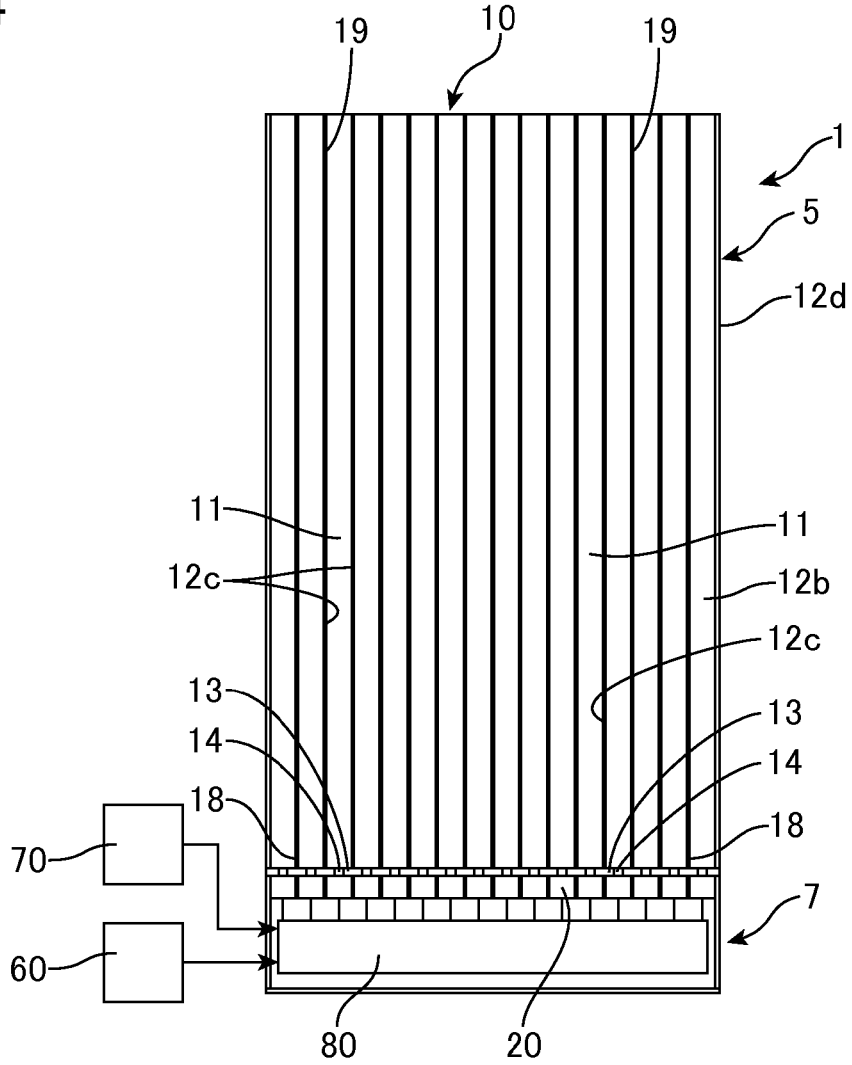
FIG. 4 is a IV-IV cross-sectional view of the display apparatus 1 where the display apparatus 1 is sliced on a vertical plane.

FIG. 4 is a cross-sectional view where the light generating block 5 and the base 7 have been sliced in the vertical direction at a position in the width direction of the light generating block 5. The light-emitting/bubble producing units 20 of the respective light generating units 10 are housed in the base 7 and the respective light-emitting/bubble producing units 20 are attached from below to the openings 14 of the base plates 13 of the light generating units 10. A control unit 80 for controlling coloration and bubble production timing of the respective light-emitting/bubble producing units 20 of the plurality of light generating units 10 is also housed inside the base 7.

Figure 5:
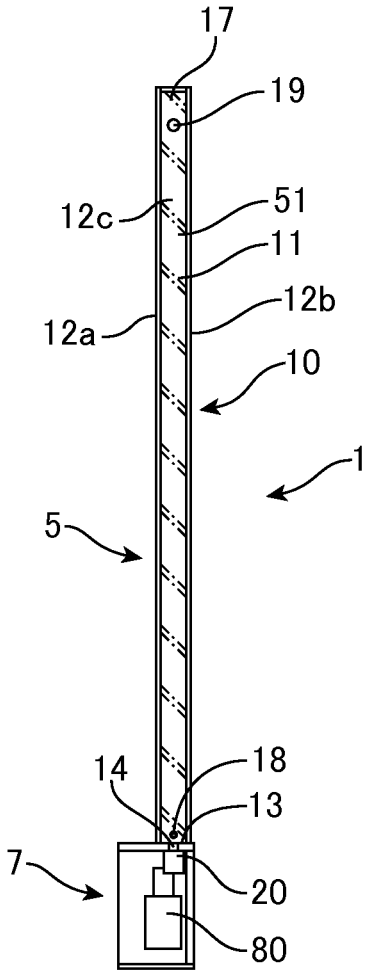
FIG. 5 is a V-V cross-sectional view of the display apparatus 1 where the display apparatus 1 is sliced on a vertical plane.

FIG. 5 is a cross-sectional view where the light generating block 5 and the base 7 have been sliced on a vertical plane at a position in the thickness direction (a direction perpendicular to the width direction) of the light generating block 5. In partition side walls 12*c* between adjacent vessels 11, out of the side walls that construct the vessels 11 of the respective light generating units 10, first through channels 18 and second through channels 19 that fluidly connect the adjacent vessels 11 are formed. The first through channels 18 are provided at the base end of each vessel 11, that is, directly above the base plates 13. The second through channels 19 are provided in the vicinity of the upper ends 17 of the vessels 11, at positions near the upper limit for filling the liquid 51. In the display apparatus 1, the second through channels 19 are holes with a diameter of around 14 to 16 mm and the first through channels 18 are holes with a diameter of around 4 to 6 mm.

These through channels 18 and 19 suppress pressure fluctuations in the liquid 51 inside the vessels 11. For example, the volume of the liquid 51 will increase when bubbles 52 are discharged into a vessel (cell) 11. For this reason, the second through channels 19 are provided at the upper end of the vessels 11 so that the liquid 51 flows into the adjacent vessels 11. The first through channels 18 at the lower end are effective in dispersing the pressure applied to each vessel 11 and keeping such pressure uniform. The first through channels 18 at the lower end also connect the plurality of vessels 11 for liquids to pass at the lower end. This means that the through channels 18 are effective when introducing and discharging the liquid 51 into or from the plurality of vessels 11 that construct the lighting block 5. However, there is the possibility that the pressure of a neighboring vessel 11 will rapidly fluctuate when bubbles 52 are discharged. That is, if the pressure when the bubbles 52 are produced is transmitted to adjacent vessels 11 via the first through channels 18, this can cause disruption to the pattern of the bubbles 52 rising inside the adjacent vessels 11. For this reason, the diameter (cross-sectional area) of the first through channels 18 at the lower end is reduced to suppress the propagation velocity of fluctuations in pressure.

Via these through channels 18 and 19, circulation of the liquid 51 in the up-down direction inside a given vessel 11 is maintained via the adjacent vessels 11, so that pressure fluctuations inside each vessel 11 are suppressed. Accordingly, even when a large amount of bubbles 52 are discharged into a vessel 11, fluctuations in the internal pressure of the vessel 11 are suppressed and it is possible for the bubbles 52 to rise smoothly along the vessel 11 at a uniform velocity.

Figure 6:
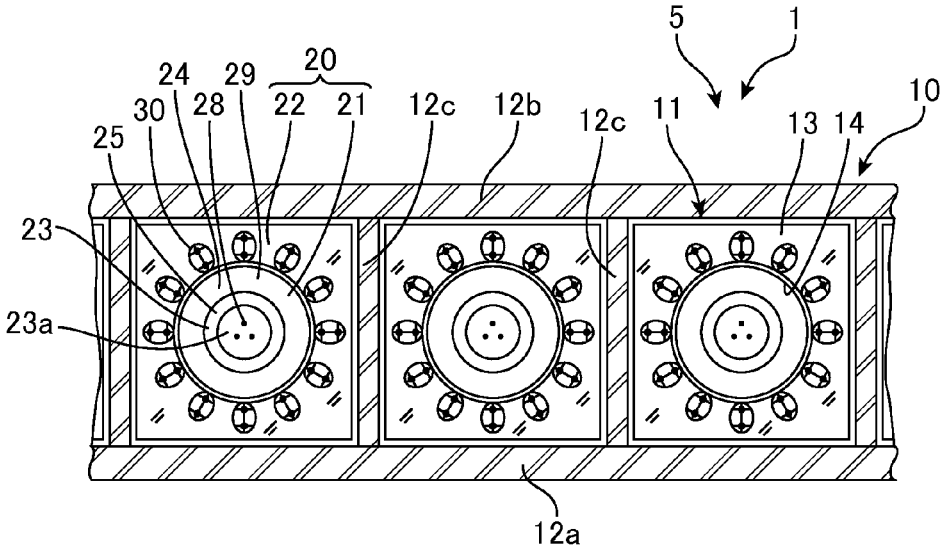
FIG. 6 is an enlarged view of a light-emitting/bubble producing unit when looking via a base plate of the display apparatus 1.
Figure 7:
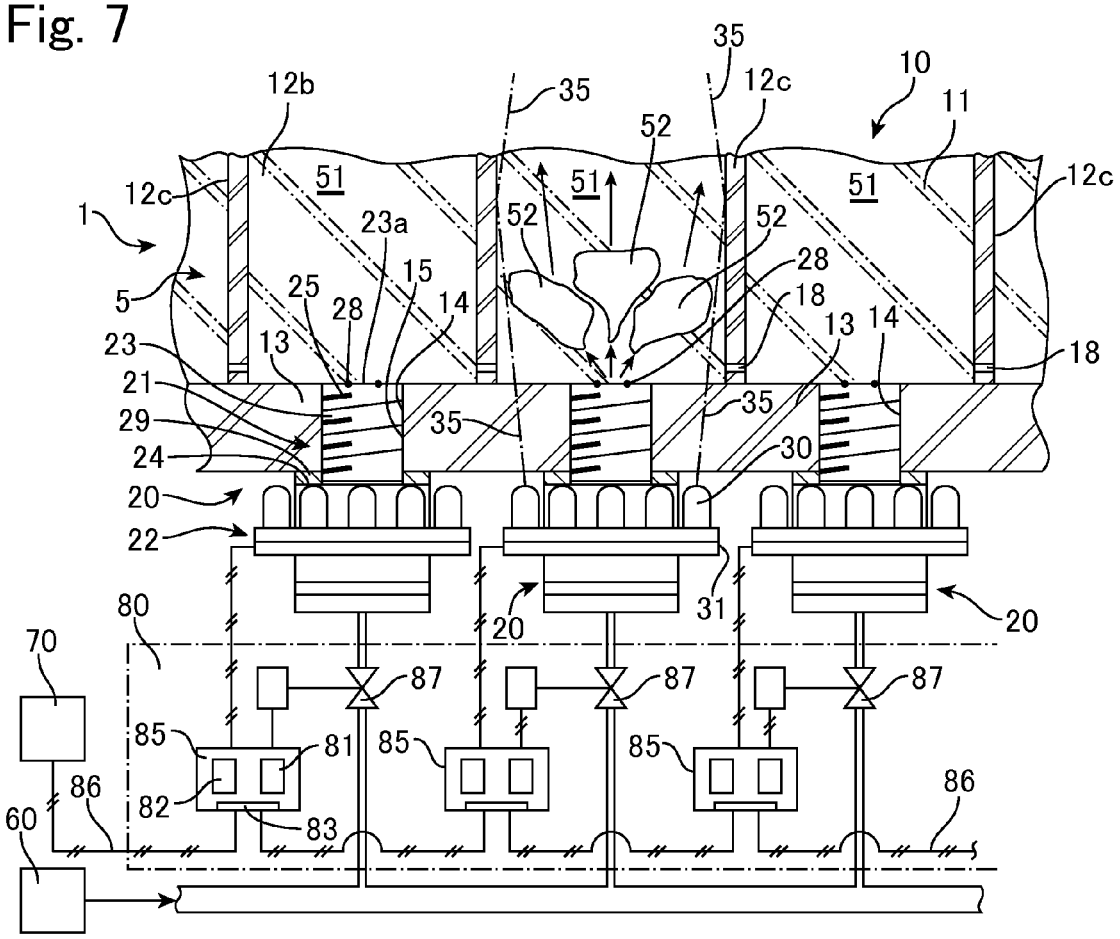
FIG. 7 is a diagram showing, by way of a partial cross-sectional view, how a light-emitting/bubble producing unit is attached to the base plate.
Figure 8:
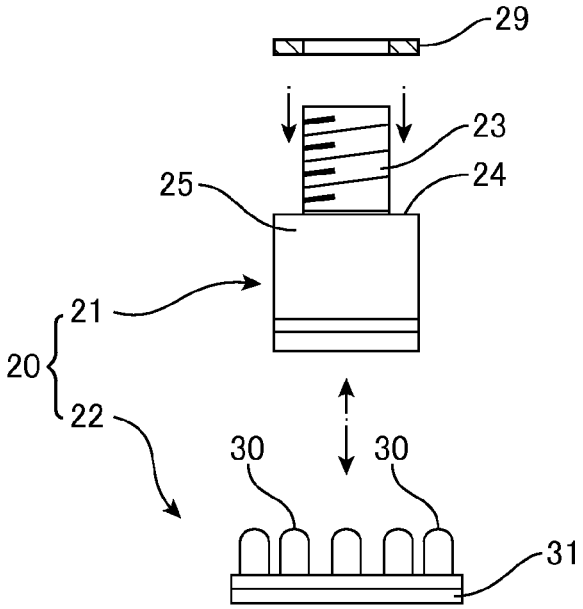
FIG. 8 is an exploded view of a light-emitting/bubble producing unit.

FIG. 6 shows the light-emitting/bubble producing units (light-emitting and bubble producing units) 20 when looking from above through the transparent base plates (bottom plates) 13 of the vessels 11. FIG. 7 shows how the light-emitting/bubble producing units 20 are attached to the base plates 13 by way of a partial cross-sectional view. FIG. 8 shows a light-emitting/bubble producing unit 20 split into a bubble producing unit 21 and a light emitting unit 22.

Each light-emitting/bubble producing unit 20 includes a bubble producing part 21 and a light emitting part 22 attached to the circumference of the bubble producing part 21. The bubble producing unit 21 is a cylindrical plug formed of resin such as polycarbonate, although another resin material may be used. Although the bubble producing unit 21 is cylindrical as a whole, the central part of the bubble producing unit 21 is formed in a step and a convex portion 23 that protrudes upward relative to the outer circumference 24 is provided. A male screw thread 25 is also formed on the outer circumference of the convex portion 23. Female screw threads 15 corresponding to the male screw threads 25 of the bubble producing units 21 are formed on the openings 14 in the centers of the base plates 13. This means that by fitting (screwing) the convex portion 23 of a bubble producing unit 21 into the opening 14 of a base plate 13 from below, it is possible to attach the light-emitting/bubble producing unit 20 to the base plate 13. Conversely, it is also possible to detach the light-emitting/bubble producing unit 20 from the base plate 13

When the convex portion 23 of the light-emitting/bubble producing unit 20 is fitted into the base plate 13 from below, the circumference (flange portion) 24 of the convex portion 23 of the bubble producing unit 21 becomes tightly attached to the lower surface of the base plate 13 with packing (an O ring) 29 in between. Accordingly, by attaching the light-emitting/bubble producing unit 20 to the opening 14 of the base plate 13, the opening 14 can be sealed by the convex portion 23 of the bubble producing unit 21 and the flange portion 24. This means that by merely attaching the light-emitting/bubble producing unit 20 from below the base plate 13, attachment of the light-emitting/bubble producing unit 20 is completed. In addition, it is extremely easy to make the upper end (the upper end of the convex portion 23) 23*a* of the bubble producing unit 21 level with the upper surface of the base plate 13.

Three gas discharging nozzles 28 are formed on the upper end (upper surface) 23*a* of the convex portion 23. By discharging air from the respective nozzles 28, it is possible to introduce a plurality of bubbles 52 into the inside of the vessel 11. Accordingly, in the light generating unit 10, it is possible to allow the bubbles 52 to rise from above the base plate 13.

The light emitting unit 22 includes a plurality of LEDs 30 and a substrate 31 that supports and also electrically connects the LEDs 30. The substrate 31 is around the same size as the cross-section of the vessel 11, that is, in the present embodiment a square with 34 mm edges or a circular disc inscribed therein. The plurality of LEDs 30 are arranged in a ring around the circumference of the substrate 31 and an opening through which the bubble producing unit 21 passes is provided in the center of the substrate 31. Accordingly, when the light-emitting/bubble producing unit 20 is assembled from the light emitting unit 22 and the bubble producing unit 21, the plurality of LEDs 30 become disposed around the circumference of the convex portion 23 equipped with the nozzles 28. In addition, when the light-emitting/bubble producing unit 20 is attached to the opening 14 of the base plate 13, the plurality of LEDs 30 are disposed around the inner surfaces of the side walls 12*a*, 12*b*, and 12*c* of the vessel 11.

The plurality of LEDs 30 include a plurality of red (R) LEDs, a plurality of green (G) LEDs, and a plurality of blue (B) LEDs, and are attached to the substrate 31 so as to be positioned around the inner surfaces of the side walls 12*a*, 12*b*, and 12*c* with an appropriate balance. That is, the numbers of LEDs (light-emitting elements) 30 that emit light of the respective colors R, G and B are selected based on the color balance and LEDs 30 of the respective colors are disposed so as to be able to illuminate the side walls 12*a*, 12*b*, and 12*c* with a favorable balance.

The refractive index of the transparent side walls 12*a*, 12*b*, 12*c*, and 12*d* (hereinafter represented by the expression "the side walls 12*a*") made of glass or acrylic is typically higher than the refractive index of the liquid (typically water or an aqueous solution) 51 contained in the vessels 11. As examples, the refractive index of water is around 1.33 and the refractive index of acrylic is around 1.45. Accordingly, the light 35 that illuminates the liquid 51 inside the vessels 11 is not totally reflected by the inner surfaces of the side walls 12*a*. However, by increasing the angle of incidence of the illumination light 35 on the inner surfaces of the side walls 12*a*, it is possible to increase the reflectance at the inner surfaces of the side walls 12*a*. It is also possible to color the side walls 12*a* using light that has leaked from the side walls 12*a*, which means that the illumination light 35 can be efficiently guided along the elongated vessels 11.

As shown in FIG. 7, in the light generating unit 10, when a light-emitting/bubble producing unit 20 is attached to the base plate 13 of a vessel 11, the plurality of LEDs (light-emitting elements) 30 become disposed around the inner surfaces of the side walls 12*a*. Accordingly, illumination light 35 from the plurality of LEDs 30 passes through the transparent base plate 13 and lights or irradiates on the inner surfaces of the side walls 12*a* with a large angle of incidence. This means that the side walls 12*a* are illuminated by the illumination light 35 from the base plate 13 and that the illumination light 35 is efficiently guided upward along the elongated vessel 11.

In the light-emitting/bubble producing unit 20, the plurality of nozzles 28 are disposed on the inside of the plurality of LEDs 30. When gas is discharged from the plurality of nozzles 28, a plurality of bubbles 52 are formed at substantially the same time. Since this plurality of bubbles 52 have a volume that increases rapidly, the bubbles 52 do not gather in the center of the vessel 11 and instead rise in a state where the bubbles 52 extend to the vicinity of the side walls 12*a*. In addition, the refractive index of the gas (typically air) that forms the bubbles 52 is 1.0, which is lower than the refractive index of the liquid (water or aqueous solution) 51. Accordingly, depending on the angle of incidence of the illumination light 35 on the surfaces of the bubbles 52, the bubbles 52 totally reflect the illumination light 35. In this way, the plurality of bubbles 52 discharged from the light-emitting/bubble producing units 20 are outputted in the same way from the light-emitting/bubble producing units 20, proceed along the elongated vessels 11, and act as light scatterers that effectively reflect the illumination light 35 in various directions. This means that with the illumination light 35, it is possible to illuminate the bubbles 52 that rise up the vessels 11 from the periphery of the bubbles 52. It is also possible to have the bubbles 52 rise along the elongated vessels 11 while light is being shone upon the bubbles 52.

In the plurality of light generating units 10 that construct the lighting block 5 of the display apparatus 1, it is possible to independently control the output timing of the bubbles 52 that rise up the vessels 11 of the light generating units 10 and the color, intensity, and timing of the illumination light 35 that illuminates the vessels 11 and the bubbles 52. Accordingly, in the light generating block 5, the respective displays of the plurality of light generating units 10 can be independently and variously changed using the bubbles 52 and the illumination light 35. This means it is possible to display (represent) a wide variety of colors, light, designs, images, and the like using the lighting block 5.

The control unit 80 that controls the coloration and bubble discharge timings of the light-emitting/bubble producing units 20 includes control boxes 85 that control the respective light-emitting/bubble producing units 20. The respective control boxes 85 include a light emission control unit 82 that controls coloration of the corresponding light-emitting/bubble producing unit 20, a bubble discharge control unit 81 that controls the bubble discharge of the corresponding light-emitting/bubble producing unit 20, and a connector 83 that is compatible with DMX standard. Accordingly, the plurality of control boxes 85 are capable of being connected in a daisy chain by a link cable 86 that is compatible with DMX standard and that it is possible to connect the light emission control unit 82 and the bubble discharge control unit 81 housed in each control box 85 using a DMX data link.

Each light emission control unit 82 is connected to the substrate 31 of a light emitting unit 22, supplies power to the respective LEDs 30 of the light emitting unit 22, and causes the respective LEDs 30 to light up at desired timing. Accordingly, by using the light emission control units 82, it is possible to control the color, timing, and intensity with which the respective vessels 11 are illuminated. Each bubble discharge control unit 81 is connected to a control valve 87 (typically a solenoid valve) that is capable of turning compressed air, which is supplied from the compressor 60, to a bubble producing unit 21 on and off. Accordingly, the control valve 87 is switched on and off at desired timing by the bubble discharge control unit 81, and by controlling the amount and timing of the air outputted from the nozzles 28 of the bubble producing unit 21, it is possible to control the size and timing of the bubbles 52 that rise inside a vessel 11.

The link cable 86 is connected to the illumination control console 70 that is compatible with DMX standard. Accordingly, it is possible to freely control the timing at which bubbles 52 are outputted in the respective light generating units 10 that construct the light generating block 5 and the color, timing, intensity, and the like of the light that illuminates each light generating unit 10 using a conventional illumination control console 70 and to also program a pattern including such timings and intensities. This means that it is possible to control the display of the light-emitting block 5 extremely easily and to display a variety of designs, information, images, and the like on the light-emitting block 5.

Figure 9:
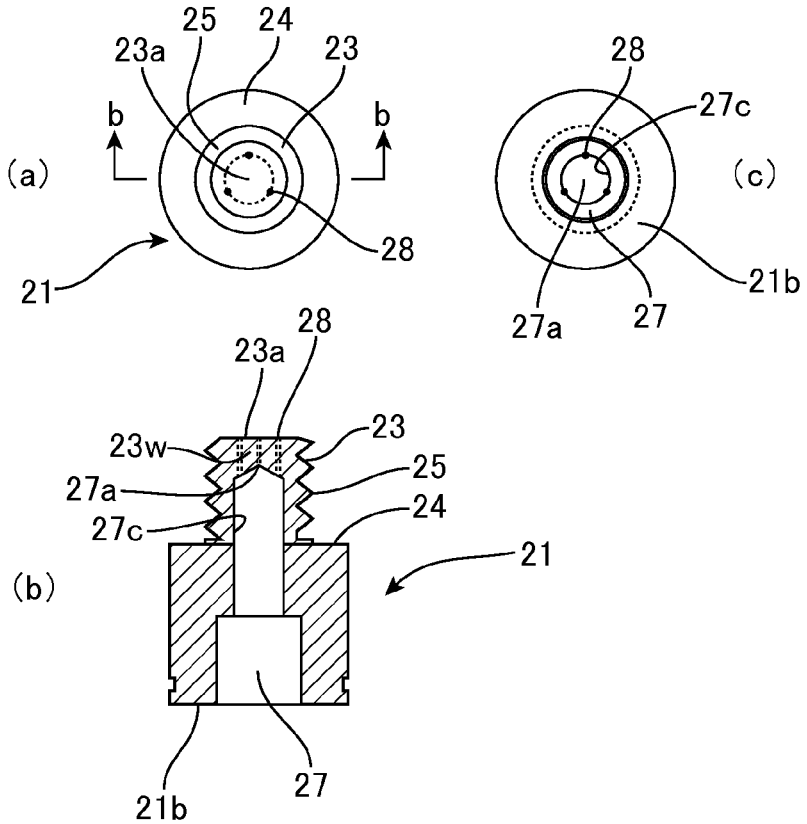
FIG. 9 is a series of diagrams showing the construction of a bubble producing unit of the light-emitting/bubble producing unit, where FIG. 9(*a*) is a plan view of the bubble producing unit, FIG. 9(*b*) is a cross-sectional view of the bubble producing unit, and FIG. 9(*c*) is a bottom view of the bubble producing unit.

FIG. 9 shows the construction of the bubble producing unit 21 of a light-emitting/bubble producing unit 20. As shown by the cross-sectional view in FIG. 9(*b*), the bubble producing unit 21 includes a cylindrical cavity 27 that passes through the flange portion 24 to reach the convex portion 23 and forms a partition wall 23*w* at the front end 23*a* of the convex portion 23. As shown in FIG. 9(*a*), the three nozzles 28 are formed at intervals of an equal angle so as to pass through the partition wall 23*w* in the direction in which the inner circumferential surface 27*c* of the cylindrical cavity 27 extends. Accordingly, the nozzles 28 are formed effectively or substantially along the inner circumferential surface 27*c* of the cavity 27 in the direction in which the inner circumferential surface 27*c* extends. For this reason, as shown in FIG. 9(*c*), the three nozzles 28 can be formed by boring holes through the cavity 27 from the rear surface side 21*b* of the bubble producing unit 21 and the entire hole boring process for the bubble producing unit 21 including the cavity 27 can be carried out from the rear surface side 21*b*. Accordingly, the bubble producing unit 21 can be provided at low cost.

In addition, the front end 27*a* of the cylindrical cavity 27 is machined into a dome shape with the nozzles 28 extending from the circumference of the dome. Accordingly, air will accumulate at the bases of the respective nozzles 28 and air can be discharged substantially uniformly from the three nozzles 28. This means that even though an air stone or the like is not used, it is still possible to form a plurality of bubbles 52 of a desired size inside a vessel 11 substantially uniformly using the bubble producing unit 21 which is manufactured from resin.

In this way, the display apparatus 1 is capable of displaying information, such as images and characters, on the lighting block 5 through combinations of the illumination light 35 and the bubbles 52 that rise inside each of the plurality of lighting units 10. The display is not limited to images and characters and the light generating block is capable of a variety of displays, representations and performances using the bubbles 52 and the illumination light 35. This means that the display apparatus 1 can be used for a wide variety of purposes such as theater equipment, lighting, an image display device, an information display device, and a message display device.

Although a plurality of light generating units 10 are arranged in a line so as to form a single wall surface in the display apparatus 1, it is also possible to arrange a plurality of light generating units 10 so as to form a pillar or a cylindrical column. It is also possible to construct a light generating block 5 in the form of a wall by arranging a plurality of light generating units 10 in a wavy pattern. It is also possible to construct a light generating block 5 in the form of a pillar by bundling a plurality of light generating units 10 in a spiral. However, the form of the display apparatus 1 is not limited to the examples described above.

Also, although LEDs are used as the light-emitting elements of the light emitting unit 22 described above, it is also possible to use other light-emitting elements, such as organic EL or semiconductor lasers, or another light-emitting device. Although a DMX link that is often used at present to control lighting is favorable as the control system of the display apparatus 1, the data link method is not limited to DMX and it is possible to use a wired or wireless LAN or a communication-type data link that uses a different protocol.

The invention claimed is:

1. A light generating block comprising a plurality of light generating units, each of the plurality of light generating units includes:

a transparent vessel that is elongated and contains a liquid; and a light-emitting/bubble producing unit attached to a base portion of the vessel, wherein the plurality of light generating units are arranged so that vessels of the plurality of light generating units construct a wall, and the light-emitting/bubble producing unit includes:

a convex portion that is fitted into an opening of a center of a transparent base plate of each of the vessels from below;

a flange portion that seals the opening of the base plate in a circumference of the convex portion;

a plurality of light-emitting elements disposed around a circumference of the flange portion so as to face the base plate and disposed around inner surfaces of side walls of each of the vessels when the convex portion is fitted into the opening of the base plate; and a plurality of nozzles for discharging a gas that are provided at the convex portion and disposed on an inside of the plurality of light-emitting elements, and wherein, by the light-emitting/bubble producing unit fitted on each of the vessels, bubbles are introduced to each of the vessels and bubbles rising in each of the vessels are illuminated on a vessel-by-vessel basis.

2. The light generating block according to claim 1, wherein the light-emitting/bubble producing unit includes a cylindrical cavity that passes through the flange portion and reaches the convex portion to form a partition wall at a front end of the convex portion, the plurality of nozzles being formed substantially in a direction in which an inner circumferential surface of the cylindrical cavity extends at intervals of an equal angle.

3. The light generating block according to claim 2, wherein a front end of the cylindrical cavity is dome-shaped.

4. The light generating block according to claim 1, wherein the plurality of light-emitting elements include a plurality of LEDs that output light of different colors.

5. An apparatus comprising:

a light generating block according to claim 1; and a control unit controlling timing of coloration and bubble discharge of respective light-emitting/bubble producing units of the plurality of light generating units.

6. The apparatus according to claim 5, wherein in the light generating block, one or more side walls of the vessels of the plurality of light generating units are also used as side walls of adjacent vessels.

7. The apparatus according to claim 5, wherein the light generating block includes first through channels that pass through and fluidly connect adjacent vessels at base ends thereof and second through channels that pass through adjacent vessels at front ends thereof to fluidly connect regions containing liquid.

8. The apparatus according to claim 7, wherein a cross-sectional area of each second through channel is larger than a cross-sectional area of each first through channel.

9. The apparatus according to claim 5, wherein the control unit includes a plurality of light emission control units that respectively control coloration of the light-emitting/bubble producing units and a plurality of bubble discharge control units that respectively control bubble discharge by the light-emitting/bubble producing units, wherein the plurality of light emission control units and the plurality of bubble discharge control units are connected in a daisy chain by a DMX data link.

* * * * *